US007063754B2

(12) United States Patent
Fukamichi et al.

(10) Patent No.: US 7,063,754 B2
(45) Date of Patent: Jun. 20, 2006

(54) MAGNETIC MATERIAL FOR MAGNETIC REFRIGERATION AND METHOD FOR PRODUCING THEREOF

(75) Inventors: Kazuaki Fukamichi, Sendai (JP); Asaya Fujita, Sendai (JP); Yoshiaki Iijima, Sendai (JP); Akiko Saito, Kawasaki (JP); Tadahiko Kobayashi, Yokohama (JP); Masashi Sahashi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 261 days.

(21) Appl. No.: 10/403,119

(22) Filed: Apr. 1, 2003

(65) Prior Publication Data

US 2004/0194855 A1 Oct. 7, 2004

(51) Int. Cl.
*H01F 1/053* (2006.01)
*H01F 1/047* (2006.01)

(52) U.S. Cl. ..... 148/301; 62/3.1; 62/3.2; 62/3.7; 62/6; 62/914; 148/306; 148/307

(58) Field of Classification Search ..... None
See application file for complete search history.

(56) References Cited

U.S. PATENT DOCUMENTS 3,626,570 A * 12/1971 Kushnir et al. ..... 75/246
4,332,135 A 6/1982 Barclay et al.
5,060,478 A * 10/1991 Fukamichi ..... 62/3.1
5,743,095 A 4/1998 Gschneidner, Jr. et al.
6,668,560 B1 * 12/2003 Zimm et al. ..... 62/3.1
6,676,772 B1 * 1/2004 Saito et al. ..... 148/301
2004/0149357 A1 * 8/2004 Kakimoto et al. ..... 148/301
2004/0231338 A1 * 11/2004 Saito et al. ..... 62/3.1

OTHER PUBLICATIONS

ASM Handbook Formerly 9th Edition, Metals Handbook, 1985 pp. 8 and 9.*
C. Zimm, et al., Advances in Cryogenic Engineering, vol. 43, pp. 1759-1766, "Description and Performance of a Near-Room Temperature Magnetic Refrigerator", 1998.

* cited by examiner

*Primary Examiner*—John P. Sheehan
(74) *Attorney, Agent, or Firm*—Oblon, Spivak, McClelland, Maier & Neustadt, P.C.

(57) ABSTRACT

The magnetic material for magnetic refrigeration according to the present invention has an $NaZn_{13}$-type crystalline structure and comprises iron (Fe) as a principal element (more specifically, Fe is substituted for the position of "Zn") and hydrogen (H) in an amount of 2 to 18 atomic % based on all constitutional elements. Preferably, the magnetic material for magnetic refrigeration preferably contains 61 to 87 atomic % of Fe, 4 to 18 atomic % of a total amount of Si and Al, 5 to 7 atomic % of La. The magnetic material for magnetic refrigeration exhibits a large entropy change in a room temperature region and no thermal hysteresis in a magnetic phase transition. Therefore, when a magnetic refrigeration cycle is configured using the magnetic material for magnetic refrigeration, a stable operation can be performed.

15 Claims, 2 Drawing Sheets

The temperature dependence of ΔS(T,ΔH=0.2T) of specimen 1

The temperature dependence of ΔS(T,ΔH=0.2T) of specimen 1

The temperature dependence of ΔS(T,ΔH=1T) of specimen 1

The temperature dependence of ΔS(T,ΔH=3T) of specimen 1

The temperature dependence of ΔS(T,ΔH=5T) of specimen 1

MAGNETIC MATERIAL FOR MAGNETIC REFRIGERATION AND METHOD FOR PRODUCING THEREOF

BACKGROUND OF THE INVENTION

1. Field of the Invention

The present invention relates to a magnetic material for magnetic refrigeration and, more particularly, to a magnetic material for magnetic refrigeration capable of realizing a magnetic refrigeration cycle in a room temperature region.

2. Description of the Related Art

Presently, a gas compression/expansion cycle is primarily used as refrigeration technology for use in a near room temperature region and in equipment closely related to daily living, more specifically, refrigerators, freezers, and air conditioners. However, the gas compression-expansion cycle is environmentally problematic, since specific freon gases cause environmental destruction. In addition, substitute freon gases may also have an adverse effect upon the environment. Against this background, clean and highly efficient refrigeration technologies, which are free from environmental problems caused by wastage of operating gases, have been demanded to be put into practical use.

Currently, magnetic refrigeration is being increasingly viewed as one such environment-friendly and highly efficient refrigeration technology. Intensive research and development of the related technologies for use in a room temperature region has been accelerated. Magnetic refrigeration generates low temperatures as follows by applying the magnetocaloric effect (a phenomenon in which when an external magnetic field is changed with respect to a magnetic material while the magnetic material is adiabatic, the temperature of this magnetic material changes).

The magnetic entropy of a magnetic material changes depending on whether a magnetic field is applied or not, owing to the difference between the degrees in freedom of the electron spin system. With this entropy change, entropy transfers between the electron spin system and the lattice system. Magnetic refrigeration uses a magnetic material having a large electron spin and exhibiting a large entropy change between the magnetic field applied state and the magnetic field removed state. Using this large entropy change, magnetic refrigeration generates low temperatures.

In the early 1900s, paramagnetic compounds represented by $Gd_3Ga_5O_{12}$ (gadolinium gallium garnet "GGG") were studied as a magnetic material having a magnetocaloric effect in the cryogenic temperature region and thus serving as working substance for refrigeration. Using such paramagnetic compounds, a magnetic refrigeration system generating cryogenic temperatures was developed.

In 1974, Brown (U.S.A.) achieved magnetic refrigeration in a room temperature region for the first time. He used a ferromagnetic material, Gd, having a ferromagnetic phase transition temperature (Tc) of about 294K.

In 1982, Barclay (U.S.A.) attempted to positively use lattice entropy that has been regarded as interference to magnetic refrigeration in the room temperature region for generate large temperature change, and proposed a refrigeration system (U.S. Pat. No. 4,332,135) in which a magnetic material is used not only to attain magnetic refrigeration due to the magnetocaloric effect but also the regenerator for storing cold generated by the magnetic refrigeration. This magnetic refrigeration system is called Active Magnetic Refrigeration (AMR).

In 1997, Zimm, Gschneidner, Pecharsky et al. (U.S.A.) built an AMR magnetic refrigeration system using a packed column filled with fine spherical Gd particles and succeeded in a continuous steady state operation of the magnetic refrigeration cycle in a room temperature region for over a year (Advances in Cryogenic Engineering, Vol. 43, 1998).

In addition to the technical demonstration of the AMR magnetic refrigeration system using Gd, Pecharsky, Gschneidner et al. (1997, U.S.A.) developed a $Gd_5$ (Ge, Si)$_4$ based magnetic materials which exhibit a very large entropy change in a room temperature region (U.S. Pat. No. 5,743,095). For example, in $Gd_5(Ge_{0.5}Si_{0.5})_4$, an entropy change ($\Delta S$) of about 20 J/(kg·K) is exhibited when the magnitude of the external magnetic field is changed from 0 to 5 tesla at about 277 K, and an entropy change ($\Delta S$) of about 15 J/(kg·K) is exhibited when the magnitude of the external magnetic field is changed from 0 to 2 tesla. As explained above, a large entropy change twice or more that of Gd is observed in a room temperature region.

In 1990, Nikitin, Annaorazov et al. (U.S.S.R.) developed an $Fe_{0.49}Rh_{0.51}$ alloy as a magnetic material capable of providing a very large entropy change in a room temperature region. The alloy is heat-treated to obtain a specimen. The specimen shows an entropy change ($\Delta S$) of about 12 J/(kg·K) when the magnitude of the external magnetic field is changed from 0 to 2.5 tesla at about 300 K. The entropy change of 12 J/(kg·K) is regarded as large as that of Gd obtained in a room temperature region. In addition, the characteristics of the magnetic refrigeration material have been reported to change sensitively to the heat treatment conditions.

As described above, in recent years, magnetic refrigeration materials to be used at room temperature have been intensively studied. As a result, a magnetic refrigeration material providing an entropy change larger than Gd has been proposed. In the case of Gd, it is applied of the entropy change accompanying an ordinary ferromagnetic phase transition (second order transition) between a paramagnetic state and a ferromagnetic state. In contrast, in either case of $Gd_5(Ge_{0.5}Si_{0.5})_4$ and $F_{0.49}Rh_{0.51}$, a first order magnetic phase transition occurs in a room temperature region, it is accompanied by a rapid and large entropy change.

However, in the first order magnetic phase transition observed in $Gd_5(Ge_{0.5}Si_{0.5})_4$ and $F_{0.49}Rh_{0.51}$, it has been reported that a very large entropy change occurs accompanying the phase transition; however, thermal hysteresis appears in a magnetocaloric effect. The degree of the thermal hysteresis is about 10K in $F_{0.49}Rh_{0.51}$ and about the same in $Gd_5(Ge_{0.5}Si_{0.5})_4$. The thermal hysteresis of the magnetocalolic effect interfere with building a heat cycle of a practical refrigerator.

Further, the melting point of $Gd_5(Ge_{0.5}Si_{0.5})_4$ is about 1800° C., which is regarded very high as a rare earth intermetallic compound. Also, the compound of $Gd_5(Ge_{0.5}Si_{0.5})_4$ is brittle in mechanical strength. Therefore, it is not easy to handle the processing of $Gd_5(Ge_{0.5}Si_{0.5})_4$ into a shape suitable for practical use. This is a problem in putting $Gd_5(Ge_{0.5}Si_{0.5})_4$ into practical use.

Since Gd and $Gd_5(Ge_{0.5}Si_{0.5})_4$ mentioned above contain a large amount of expensive Gd element, and $F_{0.49}Rh_{0.51}$ contains a large amount of very expensive Rh element, it is difficult to apply these alloys to daily use equipment such as refrigerators and air conditioners, in view of cost.

BRIEF SUMMARY OF THE INVENTION

The present invention has been contrived in view of the aforementioned problems associated with conventional magnetic materials for magnetic refrigeration used in a room temperature region. An object of the present invention is to provide a magnetic material for magnetic refrigeration exhibiting magnetic phase transition accompanied by a large entropy change in a room temperature region without thermal hysteresis in a magnetocaloric effect, thereby building a stable magnetic refrigeration cycle. Another object of the present invention is to provide a magnetic material for magnetic refrigeration that can be produced at a lower cost than a conventional one.

A magnetic material for magnetic refrigeration according to the present invention has an $NaZn_{13}$-type crystalline structure and comprises iron (Fe) as a principal element and hydrogen (H) in an amount of 2 to 18 atomic % based on all constitutional elements.

In the crystalline structure mentioned above, mainly Fe is substituted for the position corresponding to "Zn", and a lanthanum series rare earth element is substituted for the position corresponding to "Na", and hydrogen (H) enters an interstitial site.

The magnetic material for magnetic refrigeration according to the present invention exhibits a large magnetocaloric effect in a room temperature region. Therefore, magnetic refrigeration can be realized by applying an external magnetic field to the magnetic material for magnetic refrigeration while changing the magnitude of the external magnetic field, thereby exchanging entropy between the electron spin system and the lattice system.

As for the magnetic material for magnetic refrigeration, thermal hysteresis does not appear in the magnetocaloric effect, a stable operation of heat cycle can be performed in a magnetic refrigerator.

Since the magnetic material for magnetic refrigeration according to the present invention contains iron (Fe) as a principal component, the cost of producing the magnetic material for magnetic refrigeration is greatly low compared to a conventional one. Therefore, the magnetic material of the present invention can be used in a wide variety of fields of consumer products.

The magnetic material for magnetic refrigeration according of the present invention preferably contains 61 to 87 atomic % of Fe, 4 to 18 atomic % of a total amount of Si and Al, and 5 to 7 atomic % of La.

The magnetic material for magnetic refrigeration according to the present invention is represented by the general formula:

$$La(Fe_{1-x}M_x)_{13}H_z,$$

where M is one or two elements selected from the group consisting of Si and Al; and x and z fall in the following ranges, respectively:

$$0.05 \leqq x < 0.2; \text{ and}$$

$$0.3 \leqq z \leqq 3.$$

Note that, in the aforementioned general formula, a part of a first constitutional element, Fe, can be substituted by a transitional metal element (or elements) such as Co, Ni, Mn, and Cr in the range of not more than 19 atomic %, based on all constitutional elements, and in the range that will maintain a large entropy change (ΔS) accompanying a field induced magnetic phase transition. Such substitution is effective to adjust the magnetic phase transition temperature and enhance the corrosion resistance and the mechanical strength.

In this case, the magnetic material for magnetic refrigeration according to the present invention, represented by the general formula:

$$La(Fe_{1-x-y}M_xT_y)_{13}H_z,$$

where M is one or two elements selected from the group consisting of Si and Al, T is one or more elements selected from the group consisting of Co, Ni, Mn, and Cr, and x, y and z fall in the following ranges, respectively:

$$0.05 \leqq x \leqq 0.2;$$

$$0 \leqq y \leqq 0.2; \text{ and}$$

$$0.3 \leqq z \leqq 3.$$

In the general formula above, a part of a third element, La, may be substituted by a rare earth element (or elements) such as Ce, Pr, and Nd in the range of not more than 1.4 atomic %, based on all constitutional elements, and in the range that maintains a large entropy change (ΔS) accompanying a magnetic phase transition. Such substitution is effective to adjust magnetic phase transition temperature and the peak width of entropy change (ΔS).

Furthermore, a part of a second constitutional element, Si or Al, can be substituted by one or more elements selected from the group consisting of C, Ge, B, Ga, and In, in the range of less than 50 atomic % based on the total amount of Si and Al, and in the range that maintains a large entropy change (ΔS) accompanying a magnetic phase transition. Such substitution is effective to adjust magnetic phase transition temperature, the peak width of entropy change (ΔS), and the melting point of a compound, and to increase the mechanical strength.

In the magnetic material for magnetic refrigeration according to the present invention, the content of oxygen is preferably set within the range of at most 20,000 ppm.

If the content of oxygen is large, oxygen and a metal element are combined to form an oxide having a high melting temperature during a melting step (a step of melting and mixing materials) when the magnetic material for magnetic refrigeration is produced.

This oxide floats as a refractory impurity in the molten metal, and impairs the quality of the material produced during the melting step and resolidification step. To prevent the formation of this oxide, it is preferable that the oxygen content be set within 20,000 ppm or less.

The magnetic material for magnetic refrigeration according to the present invention is preferably formed into spherical particles having an average particle diameter of 100 to 1500 μm.

In practical use, to attain a high cooling ability, it is important to sufficiently promote heat exchange between a magnetic material for magnetic refrigeration packed in a magnetic refrigeration chamber and a heat exchange medium which transports heat (or cold) to the material to be cooled. To allow the heat exchange sufficiently, it is necessary to increase the specific surface of a magnetic material for magnetic refrigeration, whereas, in the case of the magnetic material of the present invention, it is effective to set a particle diameter at a small value to increase the specific surface of a magnetic material. However, if the particle diameter is too small, the pressure loss in the heat exchange medium increases. In consideration of this, the most suitable particle diameter must be selected. In this case, the particle diameter of the magnetic material preferably falls within the range of 100 to 1500 μm.

The magnetic material of the present invention can be produced, for example, by the following method.

(i) melting a raw material containing 60 to 90 atomic % of Fe, 4 to 25 atomic % of a total amount of Si and Al, and 5 to 10 atomic % of La, followed by solidifying the molten material to obtain an ingot;

(ii) subjecting the ingot to uniformization annealing at a temperature of 1000° C. to 1250° C. to produce a mother alloy;

(iii) spraying and scattering molten drops in a chamber under an inert gas atmosphere to form into spherical drops with the help of the surface tension thereof, and simultaneously solidifying the spherical drops while floating in the atmosphere, thereby obtaining spherical particles having an average particle diameter of 100 to 1500 μm; and (iv) subjecting the spherical particles to heat treatment in a hydrogen atmosphere to prepare spherical particles containing 2 to 18 atomic % of hydrogen.

According to the production method above, it is possible to obtain spherical particles suitable for practical use and having a uniform hydrogen concentration from the surface to the core. The mother alloy has a melting point of about 1500° C. and is formed into spherical particles without any problem.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Next, several magnetic materials according to the present invention for magnetic refrigeration in a room temperature region will be explained.

Six specimens having compositions shown below were prepared and measured their magnetization curves and evaluated entropy changes accompanying a change in magnetic field. Specimens 1 to 6 described below are magnetic materials for magnetic refrigeration according to the present invention. The symbol "%" refers to atomic percentage.

Specimen 1: Fe:76.3%, Si:10.4%, La:6.7%, H:6.7%

Specimen 2: Fe:77.3%, Si:10.5%, La:6.8%, H:5.4%

Specimen 3: Fe:80.1%, Co:0.9%, Al:8.0%, La:6.8%, H:4.1%

Specimen 4: Fe:80.0%, Co:10.9%, La:7.0%, H:2.1%

Specimen 5: Fe:81.3%, Co:0.9%, Si:8.1%, La:6.9%, H:2.8%

Specimen 6: Fe:76.4%, Si:11.4%, La:6.8%, H:5.4%

A Fe—Si—La based mother alloy, Fe—Al—La based mother alloy, and Fe—Si—La based mother alloy containing a small amount of Co, were prepared by arc melting. These mother alloys were subjected to uniformization annealing in a vacuum at a temperature of about 1050° C. for 10 days.

The mother alloys were then subjected to a heat treatment in a pressurized hydrogen (H) atmosphere (about 100 to 300° C.) and then subjected to another heat treatment in a reduced-pressure argon (Ar) atmosphere (about 100 to 300° C.). In this manner, individual mother alloys were allowed to absorb hydrogen. Conditions of the heat treatment process for absorbing hydrogen and stabilizing were changed to obtain six types of specimens. The dependence of magnetization upon the magnetic field at various temperature for these specimens were measured.

Thereafter, an entropy change, ΔS(T, ΔH) of the electron spin system was calculated when an external magnetic field was changed with respect to each of these specimens by using magnetization curves thereof and the following equation.

$$\Delta S(T, \Delta H) = \int_0^{\Delta H} \left( \frac{\partial M(T, H)}{\partial T} \right)_H dH$$

Figure 1:
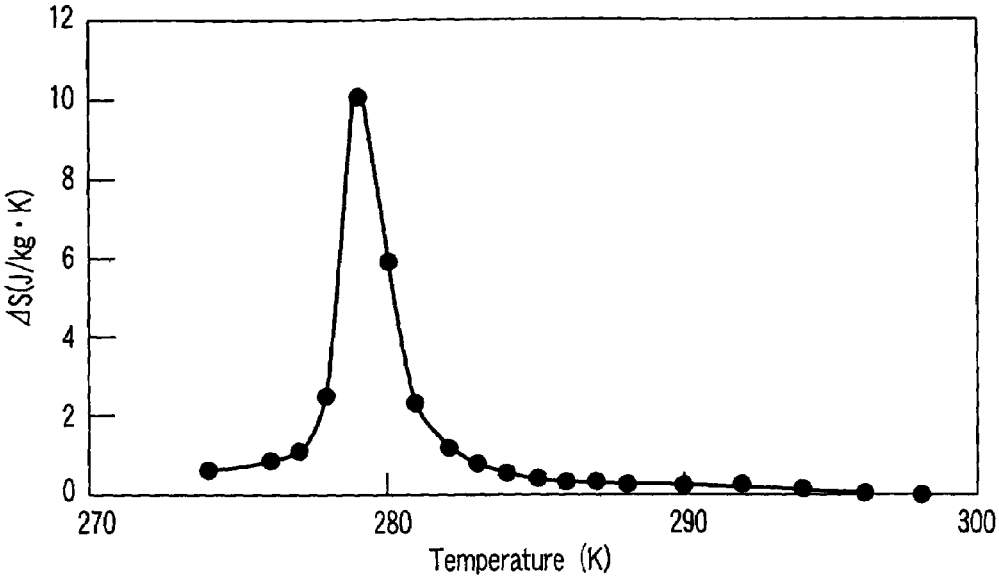
FIG. 1 is a graph showing temperature versus entropy change (ΔS) of specimen 1 when an external magnetic field is varied between 0 to 0.2 tesla.
Figure 2:
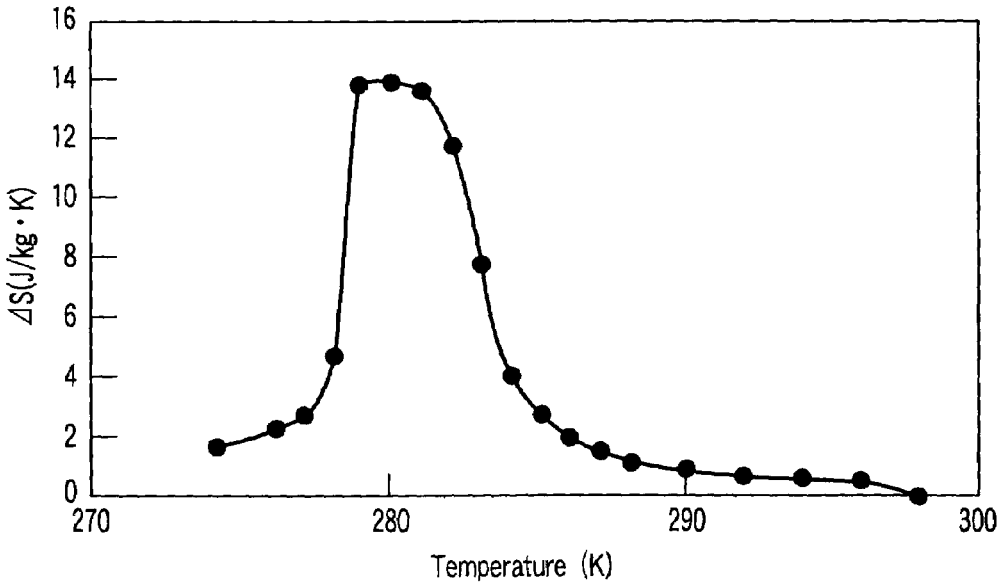
FIG. 2 is a graph showing temperature versus entropy change (ΔS) of specimen 1 when an external magnetic field is varied between 0 to 1 tesla.
Figure 3:
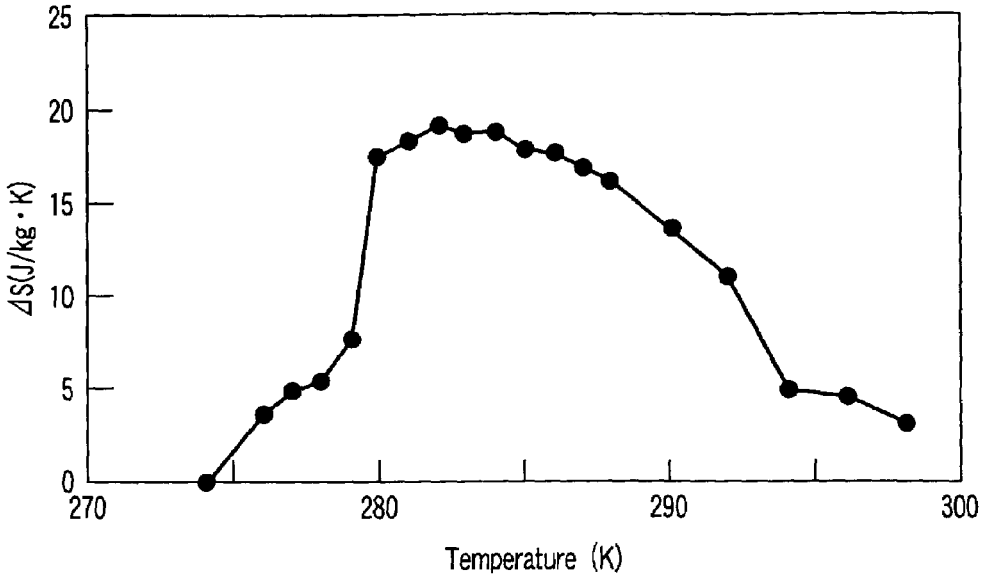
FIG. 3 is a graph showing temperature versus entropy change (ΔS) of specimen 1 when an external magnetic field is varied between 0 to 3 tesla.
Figure 4:
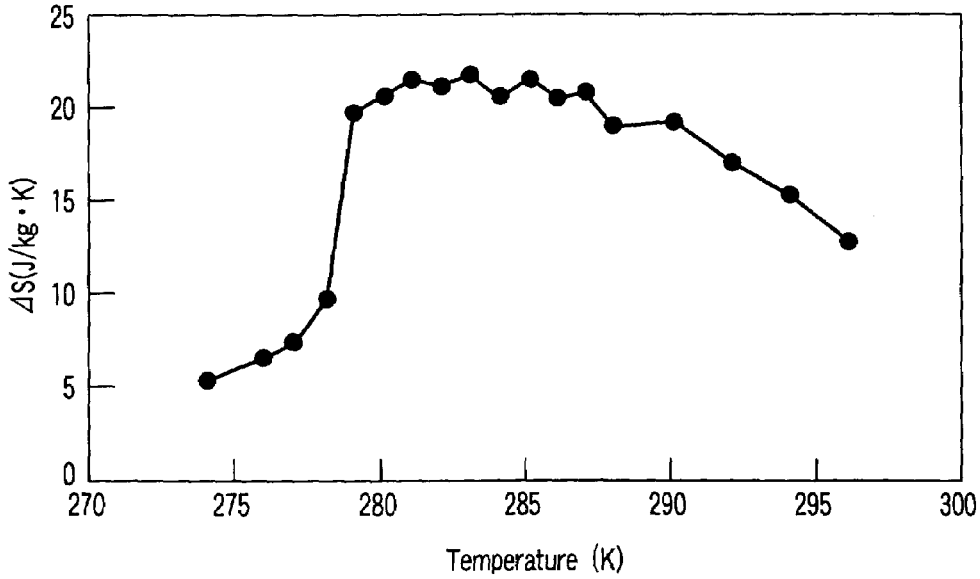
FIG. 4 is a graph showing temperature versus entropy change (ΔS) of specimen 1 when an external magnetic field is varied between 0 to 5 tesla.

FIGS. 1 to 4 show the calculation results of an entropy change ΔS(T, ΔH) of the electron spin system with respect to specimen 1 when the magnitude of the external magnetic field was changed from 0 to 0.2 tesla, 0 to 1 tesla, 0 to 3 tesla, and 0 to 5 tesla, respectively. When the external magnetic field is changed from 0 to 5 tesla, a very large entropy change exceeding 20 (J/kg·K) is observed in a wide temperature range over 8K.

An entropy change ΔS of the electron spin system was also obtained in the same manner with respect to specimens 2 to 6 when the magnitude of the external magnetic field was changed.

Table 1 shows calculation results of entropy change $\Delta S_{max}$ of individual specimens with relative to the change ΔH in magnetic field strength at the temperature ($T_{peak}$) at which an entropy change ΔS shows a maximum value. For comparison, Table 1 also shows the entropy changes of Gd as a prototype, $F_{0.49}Rh_{0.51}$, and $Gd_5(Ge_{0.5}Si_{0.5})_4$.

TABLE 1

| Change in magnetic field | Entropy change: $\Delta S_{max}$ [J/(K · Kg)] | | | | | | | | |
|---|---|---|---|---|---|---|---|---|---|
| | Specimen No. | | | | | | Comparative data | | |
| strength ΔH (tesla) | 1 | 2 | 3 | 4 | 5 | 6 | Gd | Fe—Rh | Gd—Ge—Si |
| 0–0.2 | 10.0 | — | — | 8.4 | — | 6.8 | 0.87 | 12.5 | — |
| 0–1.0 | 14.1 | — | — | 15.2 | — | 9.1 | 3.2 | 12.2 | — |
| 0–2.0 | 17.6 | 16.5 | 7.3 | 19.3 | 12.3 | 14.6 | 5.2 | 11.8 | 14.0 |
| 0–3.0 | 19.2 | — | — | 20.8 | — | 17.0 | 6.9 | — | — |
| 0–5.0 | 22.1 | 21.7 | 12.2 | 23.0 | 16.8 | 20.1 | 9.5 | — | 19.0 |
| $T_{peak}$ (K) | 285 | 273 | 270 | 220 | 250 | 280 | 295 | (292) | 277 |

TABLE 1-continued

| Change in magnetic field | Entropy change: $\Delta S_{max}$ [J/(K · Kg)] | | | | | | | | |
|---|---|---|---|---|---|---|---|---|---|
| | Specimen No. | | | | | | Comparative data | | |
| strength ΔH (tesla) | 1 | 2 | 3 | 4 | 5 | 6 | Gd | Fe—Rh | Gd—Ge—Si |

$\Delta S_{max} = \Delta S(T_{peak}, \Delta H)$
$T_{peak}$: the temperature at which ΔS exhibits a peak. ΔS is an entropy change when a magnetic field changes by ΔH. However, $T_{peak}$ in column "Fe—Rh" is the temperature at which ΔS exhibits a peak when a magnetic field changes by ΔH = 2.5.
Fe—Rh = $Fe_{0.49}Rh_{0.51}$;
Gd—Ge—Si = $Gd_5(Ge_{0.5}Si_{0.5})_4$ As is apparent from Table 1, significantly large entropy changes are observed compared to Gd with respect to specimens 1 to 6. Large entropy changes are observed even compared to $F_{0.49}Rh_{0.51}$ and $Gd_5(Ge_{0.5}Si_{0.5})_4$ with respect to specimens 1, 2, 4, and 6.

Note that large thermal hysteresis beyond experimental errors (about 2K) was not observed in the magnetocalolic effects.

As described above, it was confirmed that a significantly large entropy change is obtained in the electron spin system in a room temperature region with respect to specimens 1 to 6.

Note that X-ray diffraction revealed that the main phase of each of specimens 1 to 6 has an $NaZn_{13}$-type crystal structure. As a result of TEM observation etc., it was found that αFe phase is slightly precipitated as the second phase.

The magnetic material for magnetic refrigeration according to the present invention exhibits a very large entropy change in a room temperature region. Magnetic refrigeration can be realized in a room temperature region by exchanging entropy between the electron spin system and lattice system by using the magnetic material for magnetic refrigeration.

Furthermore, since thermal hysteresis does not appear in the magnetocaloric effect, a steady operation can be performed when a heat cycle for refrigeration is configured by using the magnetic refrigerating material of the present invention.

Moreover, since the magnetic material for magnetic refrigeration of the present invention contains iron (Fe) as a principal component, the manufacturing cost is greatly low compared to conventional magnetic refrigerating materials. Therefore, the magnetic materials can be used in a wide variety of fields of consumer products.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A magnetic material for magnetic refrigeration having an $NaZn_{13}$-type crystalline structure and comprising iron (Fe) as a principal element and hydrogen (H) in an amount of 2 to 18 atomic % based on all constitutional elements, wherein Fe is contained in an amount of 61 to 87 atomic %; a total amount of Si and Al, in an amount of 4 to 19 atomic %; and La, in an amount of 5 to 7 atomic %.

2. The magnetic material for magnetic refrigeration according to claim 1, represented by the general formula:

$$La(Fe_{1-x}M_x)_{13}H_2,$$

where M is one or two elements selected from the group consisting of Si and Al; and x and z fall in the following ranges, respectively:

$$0.05 \leqq x \leqq 02; \text{and}$$

$$0.3 \leqq z \leqq 3.$$

3. The magnetic material for magnetic refrigeration according to claim 1, represented by the general formula:

$$La(Fe_{1-x-y}M_xT_y)_{13}H_z$$

where M is one or two elements selected from the group consisting of Si and Al, T is one or more elements selected from the group consisting of Co, Ni, Mn, and Cr, and x, y and z fall in the following ranges, respectively:

$$0.05 \leqq x \leqq 0.2;$$

$$0 \leqq y \leqq 0.2; \text{ and}$$

$$0.3 \leqq z \leqq 3.$$

4. The magnetic material for magnetic refrigeration according to claim 1, wherein the content of oxygen is 20,000 ppm or less.

5. The magnetic material for magnetic refrigeration according to claim 1, formed into spherical particles having an average particle diameter of 100 to 1500 μm.

6. The magnetic material for magnetic refrigeration according to claim 1, obtained by:

melting a raw material containing 60 to 90 atomic % of Fe, 4 to 25 atomic % of a total amount of Si and Al, and 5 to 10 atomic % of La, followed by solidifying the molten raw material to form an ingot, subjecting the ingot to uniformization annealing at a temperature of from 1 0000C to 1250° C to form a mother alloy, spraying and scattering molten drops of the mother alloy in a chamber under an inert gas atmosphere to form spherical drops while solidifying the spherical drops in the atmosphere, and subjecting the spherical particles to heat treatment in a hydrogen atmosphere to prepare spherical particles containing 2 to 18 atomic % of hydrogen.

7. The magnetic material for magnetic refrigeration according to claim 1, wherein Fe is contained in an amount of from 76.3 to 81.3%.

8. The magnetic material for magnetic refrigeration according to claim 1, wherein H is contained in an amount of from 2.1 atomic % to 6.8 atomic %.

9. The magnetic material for magnetic refrigeration according to claim 1, wherein Co is contained in an amount of from 0.9 atomic % to 10.9 atomic %.

10. The magnetic material for magnetic refrigeration according to claim 1, wherein Si is contained in an amount of from 10.4 atomic % to 11.4 atomic %.

11. The magnetic material for magnetic refrigeration according to claim 1, wherein an αFe phase is present in a precipitated form as a second phase.

12. The magnetic material for magnetic refrigeration according to claim 1, consisting of Fe, Si, La, and H.

13. The magnetic material for magnetic refrigeration according to claim 1, consisting of Fe, Co, La, and H.

14. The magnetic material for magnetic refrigeration according to claim 1, consisting of Fe, Co, Si, La, and H.

15. The magnetic material for magnetic refrigeration according to claim 1, consisting of Fe, Co, Al, La, and H.

* * * * *